United States Patent [19]

Platt

[11] Patent Number: 4,927,008

[45] Date of Patent: May 22, 1990

[54] MULTI-CELLED PAPERBOARD CONTAINER WITH V-SHAPED WINDOWS

[75] Inventor: Ronald G. Platt, Chicago, Ill.

[73] Assignee: Perfect Carton Corporation, Chicago, Ill.

[21] Appl. No.: 386,981

[22] Filed: Jul. 31, 1989

[51] Int. Cl.[5] ..... B65D 25/00

[52] U.S. Cl. ..... 206/45.31; 220/21; 229/120.08

[58] Field of Search ..... 206/45.31, 45.34; 220/21, 22

[56] References Cited

U.S. PATENT DOCUMENTS

| | | | |
|---|---|---|---|
| 1,911,215 | 5/1933 | Walter | 206/45.31 |
| 3,262,559 | 7/1966 | Geiger | 206/45.31 |
| 3,575,286 | 4/1971 | Rosenburg, Jr. | 206/45.31 |
| 3,937,391 | 2/1976 | Focke . | |
| 4,171,046 | 10/1979 | Bonczyk . | |
| 4,471,870 | 9/1984 | Uhlig . | |

FOREIGN PATENT DOCUMENTS

| | | | |
|---|---|---|---|
| 640636 | 3/1964 | Belgium | 206/45.31 |
| 1427897 | 1/1966 | France | 206/45.31 |

*Primary Examiner*—William Price

*Attorney, Agent, or Firm*—Allegretti & Witcoff, Ltd.

[57] ABSTRACT

A carton or container is provided having a plurality of cells each capable of containing an article, such as a plastic or glass bottle. Side walls of the container contain cut-out windows through which articles enclosed in the package may be viewed. The bottom of the window cut-outs is generally v-shaped such that the articles can be quickly loaded into the container without hanging up, or lodging in the cut-out window.

10 Claims, 1 Drawing Sheet

MULTI-CELLED PAPERBOARD CONTAINER WITH V-SHAPED WINDOWS

BACKGROUND OF THE INVENTION

The invention relates to a carton or container capable of holding a cylindrical article. More specifically this invention relates to a multi-celled paperboard container with cut-out windows which allow the contents of all or selected cells of the container to be viewed by a person without opening the container.

Paperboard cartons or containers capable of holding a plurality of articles such as cans, bottles, and the like are well known and widely used. Many of these paperboard containers have built-in windows so that the contents of the containers may be viewed without opening the container. Paperboard containers with built-in windows are normally loaded with the appropriate articles after the container has been assembled. The loading of articles into a prefabricated paperboard container comprising cut-out windows has posed some problems. Quite often the articles being loaded into the containers hang up or lodge in the horizontal straight edge bottom dimension of the cut-out windows in prior constructions. This straight edge bottom cut-out window dimension acts like a ledge which supports the article being loaded into the container. This problem is typicalLy remedied by adjusting the articles by hand or mechanically dislodging them, which results in the operation of automatic loading apparatus at a relatively slow rate.

SUMMARY OF THE INVENTION

An object of this invention is to provide an improved package or container wherein the disadvantages and deficiencies of prior devices are obviated.

Another object of the present invention is to provide an improved package or container which contains cut-out windows, so that constructed and arranged the container is capable of being loaded manually or automatically with articles at a high loading rate, without the articles hanging up or becoming lodged in the cut-out windows.

A further object of this invention is to provide a six-celled paperboard container comprising cut-out windows with a v-shaped bottom dimension for conveying cylindrical articles. Other objects and advantages will become more apparent hereinafter.

Accordingly, the present invention is a container for use in the carrying of a plurality of articles. The container has a wall structure including an integral bottom, front, back, and side walls and an optional top wall. The side walls and front and back walls comprise at least one cut-out window useful for viewing the articles carried by the container. The container is characterized in that the bottom dimension of the cut-out window is generally v-shaped so as to facilitate the loading of the articles into the container.

A preferred embodiment of the container of this invention is a six-celled paperboard container for the conveyance of cylindrical articles. The six-celled paperboard container has an integral bottom, front, back, and side walls. The container comprises cut-out windows in the front and back walls to facilitate the viewing of the articles enclosed by the six-celled container. The six-celled container is characterized in that the bottom dimension of each cut-out window is v-shaped.

DETAILED DESCRIPTION OF THE INVENTION

Figure 1:
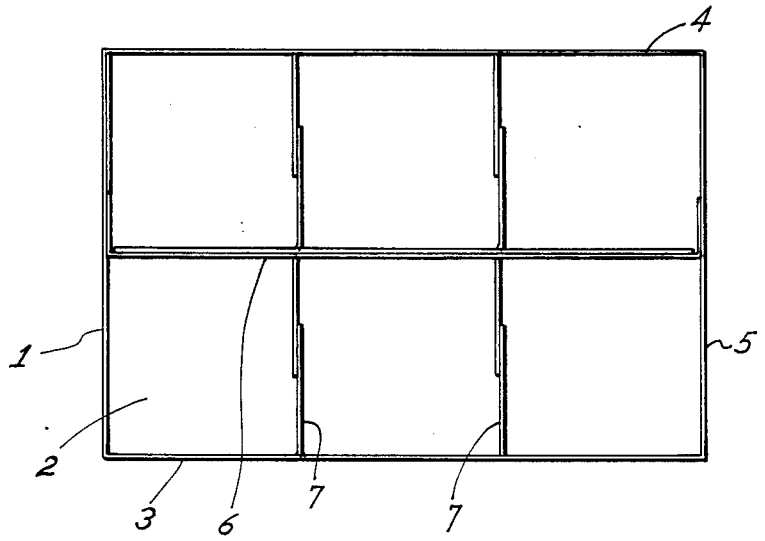
FIG. 1 is a top view of the preferred six-celled paperboard container of this invention.

To summarize, the present invention relates to an improved package or container comprising cut-out windows having a bottom dimension shaped to facilitate loading of articles into the cells of the container.

The container of this invention is also commonly known as a package or a box and is useful in providing a means by which articles such as cans, bottles, cylinders, and the like may be carried and displayed. The container of this invention may be constructed of various materials known in the art, such as paperboard or plastic. Paperboard is the preferred material of the container of this invention.

Like many paperboard containers, the container of this invention may be constructed and assembled in various manners. The container may be assembled out of a plurality of pieces of paperboard by gluing or otherwise attaching the discreet pieces of paperboard into a container. Alternatively, the container may be assembled from a single unitary blank of paperboard that has been cut and perforated such that a container may be quickly assembled from the single paperboard blank by folding the paperboard at the perforations and adhering appropriate sites on the blank to form the container. It is most preferred that the paperboard container of this invention be formed from unitary blank of paperboard material.

The paperboard container of this invention may comprise a single cell to contain one article, but more commonly the paperboard container will comprise multiple discrete cells to contain multiple articles. A "cell" is considered to be a single discrete three dimensional cubicle capable of containing an article. Where the paperboard container comprises more than one cell, each cell is segregated from the other cells by means of internal dividing walls. The internal dividing walls may be inserted as a separate piece into the container or may be constructed into the container as an integral part of the unitary piece of paperboard.

The preferred six-celled container of this invention will typically comprise multiple rowed compartments for holding a single article in each cell. The cells are typically geometrically equivalent, discrete, and will each hold similarly shaped and sized articles. The cells of the preferred six-celled container should be distributed in a regular geometric array. Normally, the cells have a maximum width dimension only slightly larger than the maximum width or diameter of the articles received therein. Preferably the cells have a square cross section whichis about 2⅛ inches by about 2⅛ inches.

The container of this invention will comprise integral bottom, front, back and side walls. The identification of the walls as front, back, or side will generally be based on the perspective o the viewer. Preferably, the two walls having the greater surface area will be designated fron and back walls while the two walls of lesser surface area are designated the side walls. The front and back walls of the preferred six-celled container of this invention will each provide the outer wall portion of three cells of the six-celled container while the side walls will each provide the outer wall portion of two cells of the six-celled container.

The container of this invention may or may not have a top wall. If the container does have a top wall then it may be a portion of the single unitary piece of paperboard used to construct the container, or, the top may be separately attached to the container. If the container does not have a top then it might be encased in shrink wrap or some other clear plastic wrap to keep the articles in the cells of the container during travel.

A myriad of articles may be contained within the single or multiple cells of the container of this invention. Such articles are typically elongated and may be cylindrical (that is the article may be elongated with a circular cross section) such as cans or bottles made of glass, metal, or plastic. Normally there is only one article per cell of the container.

The most important aspect of this invention is the cut-out window which may be located in the front, side, or back wall of the container of this invention. The purpose of the cut-out windows are to apprise a viewer of the types of articles held in the cells of the container without opening it.

By cut-out windows as used herein it is meant that the material used to manufacture the carton has been manufactured such that there is one or more blanks of material missing from a wall of the container. The cut-out window may be covered with a clear plastic material or alternatively left uncovered. It is preferred that there is a cut-out window in one outer wall of each cell of the container of this invention. The cut-out windows need not be of the same size or shape, except insofar as the shape of the bottom dimension is concerned. The six-celled container of this invention preferably comprises cut-out windows located on two opposing walls of the container and corresponding to each cell of the container such that the two opposing walls are mirror images of one another.

The container of this invention will be preferably formed from a unitary piece of paperboard and assembled into its container form. Following assembly the appropriate articles will be placed into the container either by hand or by mechanical means. When the bottom portion of the cut-out window is a straight edge parallel to the bottom of the container then the articles being loaded into the container will quite often lodge or become hung up in the cut-out windows requiring extra effort to dislodge the articles and to place them correctly within the cells of the container. This article loading problem has been alleviated by shaping the bottom dimension of the cut-out window of the container of this invention in a generally v-shaped form to facilitate the loading of articles into the container. The angle of the v-shaped bottom dimension is usually greater than 90°, and preferably on the order of 120°. The angle may vary depending upon the width of the cell. It is also preferred that the two legs of the v-shaped bottom dimension are essentially equal in length. This improvement can be better understood by reference to the attached figures.

FIG. 1 is a top view of a preferred six-celled article of this invention. The container comprises side walls 1 and 5 and front wall 3 and back wall 4. The container is formed into six geometrically equivalent cells 2 by means of a middle dividing wall 6 passing from side wall 1 to side wall 5 and by two equivalently spaced dividing walls 7 passing between front wall 3 and back wall 4. Cut-out windows will preferably be located on the front wall 3 and/or the back wall 4.

Figure 2:
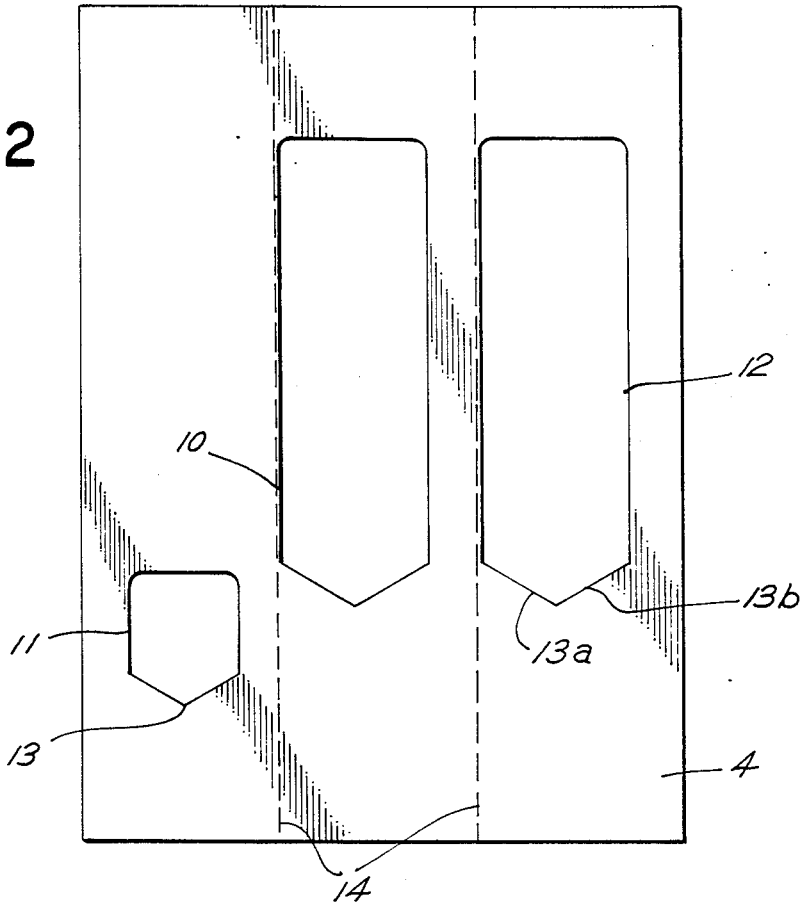
FIG. 2 is a front view of the preferred six-celled paperboard container of this invention depicting cut-out windows useful for viewing the contents of the container.

FIG. 2 is a view of a front or back wall of the container of this invention. The front wall contains three distinct cut-out windows 10, 11, and 12, each separately associated with a single cell of the six-celled container. Each cell is vertically depicted by dashed line 14. The bottom dimension 13, of the cut-out windows of the front wall of the container of FIG. 2 is shaped like the sides of an inverted triangle or may be alternatively described as being v-shaped. The bottom dimension 13 is generally v-shaped and is comprised of two straight wall segments **13*a* and 13*b* not parallel to the container bottom that converge with one another. The segments 13*a* and 13*b* are shown as being of equal length, however some small variation can occur without materially affecting the enhanced packing rates attained by this invention. The segments 13*a* and 13*b* converge at a point as shown. A slight curve at the juncture will not materially affect the enhanced packing rates attained by this invention. The straight wall segments 13*a* and 13*b*** form an angle of about 120° in a presently preferred embodiment.

In tests comparing article loading ability, containers of the present invention comprising a cut-out window with a v-shaped bottom dimension having two $\frac{7}{8}$ inch legs located about 120° apart with containers having cut-out windows with a straight edge bottom dimension. When the bottom dimension of the cut-out window is generally v-shaped an article being loaded into the particular cell containing the cut-out window with the special bottom dimension will not lodge in the window but will slide down, for example, the inverted triangular or v-shaped dimension and fall into place in the bottom of the container. By forming the bottom dimension of the cut-out windows generally v-shaped as in this invention, the container may be loaded either manually or mechanically at a rate signficantly faster than a prior art container having a cut-out window that has a straight edge bottom dimension parallel to the bottom of the container.

Variations in the structure and formation of the carton or container of this invention will become apparent to those skilled in the art. Any such variations, as are within the spirit and scope of this invention, are intended to be encompassed within the scope of the claims appended hereto, and are protected by any United States patent issued upon this invention.

What is claimed is:

1. In a paperboard container for carrying a cylindrical article, the container having a wall structure including side, bottom, front, and back walls with the side or front or back walls comprising at least one cut-out window useful for viewing the cylindrical article conveyed by said container, the container characterized in that the bottom of the cut-out window is generally V-shaped so as to facilitate the loading of the cylindrical articles into the container.

2. The container of claim 1 further characterized in that it comprises a plurality of cells.

3. The container of claim 1 further characterized in that it comprises six geometrically equivalent cells.

4. The container of claim 1 further characterized in that the bottom dimension of the cut-out window is v-shaped, with the sides defining the v-shape forming an angle of about 120°.

5. The container of claim 1 further characterized in that the articles conveyed by the container are cylindrical in cross section.

6. The container of claim 1 further characterized in that the front and back walls contain cut-out windows and are mirror images of each other.

7. In a multi-celled paperboard container having a plurality of individual cells for the conveyance of cylindrical articles having a wall structure including bottom, front, and back walls and comprising cut-out windows in the front and back walls to facilitate the viewing of the cylindrical articles conveyed in the individual cells in the multi-celled container, the multi-celled container characterized in that the bottom of each cut-out window is generally V-shaped for facilitating loading of the cylindrical articles into the individual cells of the multi-celled container.

8. The multi-celled paperboard container of claim 7 further characterized in that the multi-celled paperboard container contains six cells, each cell containing a cut-out window.

9. The multi-celled container of claim 7 further characterized in that the cells are geometrically equivalent.

10. The multi-celled container of claim 7 further characterized in that the container has an integral top wall.

* * * * *